US012207686B1

(12) United States Patent
Devillier

(10) Patent No.: US 12,207,686 B1
(45) Date of Patent: Jan. 28, 2025

(54) VORTEXER FOR CAP OF PERSONAL VAPORIZER

(71) Applicant: My Next Idea LLC, Thornton, CO (US)

(72) Inventor: William Joseph Devillier, Thornton, CO (US)

(73) Assignee: My Next Idea, LLC, Thornton, CO (US)

( * ) Notice: Subject to any disclaimer, the term of this patent is extended or adjusted under 35 U.S.C. 154(b) by 0 days.

(21) Appl. No.: 18/827,144

(22) Filed: Sep. 6, 2024

(51) Int. Cl.

| | |
|---|---|
| ***A24F 40/485*** | (2020.01) |
| ***A24F 7/02*** | (2006.01) |
| ***A24F 40/40*** | (2020.01) |
| ***A24F 40/70*** | (2020.01) |
| *A24F 40/10* | (2020.01) |

(52) U.S. Cl.
CPC ..... *A24F 40/485* (2020.01); *A24F 40/70* (2020.01); *A24F 40/10* (2020.01)

(58) Field of Classification Search
CPC ..... A24F 40/485; A24F 7/00; A24F 40/40; A24F 7/02; A24F 40/42
See application file for complete search history.

(56) References Cited

U.S. PATENT DOCUMENTS

| | | | | |
|---|---|---|---|---|
| 9,326,547 | B2 | 5/2016 | Tucker et al. | |
| 9,351,522 | B2 | 5/2016 | Safari | |
| 10,398,178 | B2 | 9/2019 | Scatterday | |
| 10,881,138 | B2 | 1/2021 | Saleem et al. | |
| 11,253,662 | B2 | 2/2022 | Liu | |
| 11,344,066 | B2 | 5/2022 | Rado | |
| 11,660,403 | B2 | 5/2023 | Atkins et al. | |
| 11,730,201 | B2 | 8/2023 | Rado | |
| 11,744,960 | B2 | 9/2023 | Campitelli | |
| 11,805,819 | B1 * | 11/2023 | Spendlove | A24F 40/46 |
| 11,825,883 | B2 | 11/2023 | Rado | |
| 11,998,047 | B2 | 6/2024 | Rado | |
| 2021/0161206 | A1 | 6/2021 | Webski | |
| 2022/0287372 | A1 | 9/2022 | Rado | |
| 2023/0036069 | A1 * | 2/2023 | Krietzman | A61M 21/00 |
| 2023/0092745 | A1 | 3/2023 | Batista | |
| 2023/0148682 | A1 * | 5/2023 | Hwang | A24F 40/10 131/194 |
| 2023/0413916 | A1 * | 12/2023 | Hwang | A24F 40/485 |
| 2024/0016224 | A1 | 1/2024 | Xu et al. | |

FOREIGN PATENT DOCUMENTS

| | | | |
|---|---|---|---|
| CN | 10834801 | B4 | 5/2016 |
| CN | 109068744 | A | 12/2018 |
| CN | 111642810 | A | 9/2020 |

OTHER PUBLICATIONS

Bear Quartz V2 Spinner Disk Set | Bear Quartz. (n.d.). Bear Quartz. https://www.bearquartz.com/product-page/bear-quartz-v2-spinner-disk-set.

* cited by examiner

*Primary Examiner* — Hae Moon Hyeon
(74) *Attorney, Agent, or Firm* — Stephen B. Katsaros; Patent Engineering, LLC

(57) ABSTRACT

The present disclosure relates to vortexer. The vortexer may be accommodated within a cap of a personal vaporizer. Further, vortexer may include at least one inlet which may be non-parallel, radially-offset from, and non-intersecting to a central axis. The at least one inlet may be configured to generate a vortex airflow with an inhalation action created by the user.

24 Claims, 13 Drawing Sheets

VORTEXER FOR CAP OF PERSONAL VAPORIZER

TECHNICAL FIELD

This disclosure pertains generally, but not by way of the field of vaporization technologies. More particularly, this disclosure pertains to the movement and manipulation of air, or airflow with a vortexer in a personal vaporizer.

BACKGROUND

Current personal vaporizers, such as e-cigarettes or vapes, often exhibit inefficiencies in generating and maintaining consistent vortex airflow within a vaporization chamber therein. These inefficiencies can result from various factors, such as sub-optimal design of air intake pathways resulting in improper airflow within. As a result, vaporization is uneven, leading to inconsistent particle size distribution in the vapor, reduced flavor delivery, and decreased performance of the personal vaporizer.

SUMMARY

Various illustrative embodiments of a vortexer for a cap (sometimes referred to herein as a mouthpiece) of the personal vaporizer are disclosed. The vortexer may be accommodated within the cap of the personal vaporizer. Further, the vortexer may include at least one inlet which may be non-parallel to a central axis. The at least one inlet may be configured to generate a vortex airflow with an inhalation action created by the user. The methods and systems to generate the airflow are explained in detail in successive configurations of this disclosure.

In an illustrative configuration, a vortexer for the cap (sometimes referred to herein as a cap) of a personal vaporizer is disclosed. The vortexer may include a proximal end, and the proximal end may be configured to adjoin to the personal vaporizer. The vortexer may include a distal end, and the distal end may be configured to interface with a mouth of a user. The vortexer may further include a tube, the tube may be protruding between the proximal end and the distal end, and the tube defines a central axis. The tube may include an inner wall, and the inner wall may be concentrically formed about the central axis. The tube may further include an outer wall, the outer wall may be concentrically formed about the central axis. The vortexer may include a shoulder, and the shoulder may be protruding from the proximal end towards the distal end. The shoulder may include a bottom face, the bottom face may be co-planar to the proximal end of the vortexer and may be perpendicular to the central axis. The shoulder may include a top face, and the top face may be parallel to and may be offset from the bottom face. The top face may be perpendicular to the central axis. The shoulder may further include an outer perimeter, and the outer perimeter may be concentrically formed about the central axis between the bottom face and the top face. The shoulder may include a first inlet which may be formed in the shoulder between the top face and the bottom face. The first inlet may define a first inlet axis, the first inlet axis may be radially-offset from, nonparallel-to, and non-intersecting with the central axis. The shoulder may further include a second inlet, and the second inlet may be formed in the shoulder between the top face and the bottom face. The second inlet may define a second inlet axis, the second inlet axis may be radially-offset from, nonparallel-to, non-intersecting with the central axis, and concentrically opposite from the first inlet. The first inlet and the second inlet may be configured to generate a vortex airflow from the proximal end when subjected to an inhalation action of the user at the distal end.

In an illustrative configuration, a cap of a personal vaporizer is disclosed. The cap may include a proximal cap end. The cap may include a distal cap end, and the distal cap end may be oppositely formed to the proximal cap end. The cap may further include an outer cap surface, and the outer cap surface may be formed between the proximal cap end and the distal cap end. The cap may include an inner cap surface defining a central cap axis. The cap may include a vortexer, and the vortexer may be accommodated within the cap. The vortexer may include a proximal end which may be vertically offset to the proximal cap end. The vortexer may include a distal end, and the distal end may be emerging from the distal cap end. The distal end may be configured to interface with a mouth of a user. The vortexer may further include a tube, which may protrude between the proximal end and the distal end, and the tube may define a central axis coinciding with the central cap axis. The tube may include an inner wall, the inner wall may be concentrically formed about the central axis. The tube may include an outer wall, the outer wall may be concentrically formed about the central axis. The vortexer may further include a shoulder, the shoulder may be protruding from the proximal end towards the distal end. The shoulder may include a bottom face, the bottom face may be co-planar to the proximal end of the vortexer and may be perpendicular to the central axis. The shoulder may include a top face, and the top face may be parallel to and offset-from the bottom face. The top face may be perpendicular to the central axis. The shoulder may further include an outer perimeter, the outer perimeter may be concentrically formed about the central axis between the bottom face and the top face. The shoulder may include a first inlet, and the first inlet formed in the shoulder between the top face and the bottom face. The first inlet may define a first inlet axis, and the first inlet axis may be radially-offset from, nonparallel-to, and non-intersecting with the central axis. The shoulder may further include a second inlet, and the second inlet may be formed in the shoulder between the top face and the bottom face. The second inlet may define a second inlet axis, and the second inlet axis may be radially-offset from, nonparallel-to, non-intersecting with the central axis, and concentrically opposite from the first inlet. The first inlet and the second inlet may be configured to generate a vortex airflow from the proximal end when subjected to an inhalation action of the user at the distal end.

In an illustrative configuration, a personal vaporizer is disclosed. The personal vaporizer may include a cap, and this cap may include a proximal cap end. The cap may include a distal cap end, and this distal cap end may be oppositely formed to the proximal cap end. The cap may further include an outer cap surface which may be formed between the proximal cap end and the distal cap end. The cap may include an inner cap surface, and the inner cap surface may define a central cap axis. The cap may include a vortexer, and the vortexer may be accommodated within the cap. The vortexer may include a proximal end, and the proximal end may be vertically offset to the proximal cap end. The vortexer may include a distal end, and the distal end may be emerging from the distal cap end. The distal end may be configured to interface with a mouth of a user. The vortexer may further include a tube, the tube may protrude between the proximal end and the distal end, and the tube may define a central axis coinciding with the central cap axis. The tube may include an inner wall which may be concentrically formed about the central axis. The tube may include an outer wall, the outer wall may be concentrically formed about the central axis. The vortexer may further include a shoulder which may be protruding from the proximal end towards the distal end. The shoulder may include a bottom face, the bottom face may be co-planar to the proximal end of the vortexer and may be perpendicular to the central axis. The shoulder may include a top face, and this top face may be parallel to and offset-from the bottom face. The top face may be perpendicular to the central axis. The shoulder may further include an outer perimeter, the outer perimeter may be concentrically formed about the central axis between the bottom face and the top face. The shoulder may include a first inlet, the first inlet formed in the shoulder between the top face and the bottom face. The first inlet may define a first inlet axis, and the first inlet axis may be radially-offset from, nonparallel-to, and non-intersecting with the central axis. The shoulder may further include a second inlet, the second inlet may be formed in the shoulder between the top face and the bottom face. The second inlet may define a second inlet axis, and the second inlet axis may be radially-offset from, nonparallel-to, non-intersecting with the central axis, and concentrically opposite from the first inlet. The first inlet and the second inlet may be configured to generate a vortex airflow from the proximal end when subjected to an inhalation action of the user at the distal end.

In an illustrative configuration, an airflow-generation method for generating a vortex airflow in a cap of a personal vaporizer is disclosed. In the first step, a cap may be provided, the cap may include a proximal cap end, a distal cap end oppositely formed to the proximal cap end, an outer cap surface formed between the proximal cap end and the distal cap end, and an inner cap surface defining a central cap axis. Further, in the next step, a vortexer may be provided, the vortexer may be accommodated within the cap, the vortexer may include a proximal end, vertically offset to the proximal cap end, and a distal end emerging from the distal cap end and configured to interface with a mouth of a user. In the next step, a tube may be provided, the tube may protrude between the proximal end and the distal end, the tube may define a central axis, and the tube may include an inner wall concentrically formed about the central axis, and an outer wall concentrically formed about the central axis. Further, in the next step, a shoulder may be provided. The shoulder may be protruding from the proximal end towards the distal end. The shoulder may include a bottom face, coplanar to the proximal end of the vortexer and perpendicular to the central axis, a top face parallel to and offset-from the bottom face, wherein the top face is perpendicular to the central axis, and an outer perimeter concentrically formed about the central axis between the bottom face and the top face. The shoulder may further include a first inlet formed in the shoulder between the top face and the bottom face, the first inlet may define a first inlet axis, and the first inlet axis may be radially-offset from, nonparallel-to, and non-intersecting the central axis. The shoulder may include a second inlet, the second inlet may be formed in the shoulder between the top face and the bottom face, the second inlet defines a second inlet axis, and the second inlet axis may be radially-offset-from, nonparallel-to, non-intersecting the central axis, and concentrically opposite from the first inlet. The first inlet and the second inlet may be configured to generate a vortex airflow from the proximal end when subjected to an inhalation action of the user at the distal end.

BRIEF DESCRIPTION OF THE DRAWINGS

The accompanying figures of the drawing, which are included to provide a further understanding of general aspects of the system/method, are incorporated in and constitute a part of this specification. These illustrative aspects of the system/method, together with the detailed description, explain the principles of the system. No attempt is made to show structural details in more detail than necessary for a fundamental understanding of the system and the various ways it is practiced. The following figures of the drawing include.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered as examples only, with the true scope and spirit being indicated by the following claims.

Many personal vaporizers have poorly designed airflow pathways that create turbulence or irregular flow patterns instead of a vortex. These poorly designed pathways have to improper chamber geometry within the personal vaporizer, resulting in dead zones and a loss of momentum in the vortex. As a result, uneven heating and vaporization may occur, therefore diminishing the user experience and reducing the overall performance of the personal vaporizer.

Figure 52:
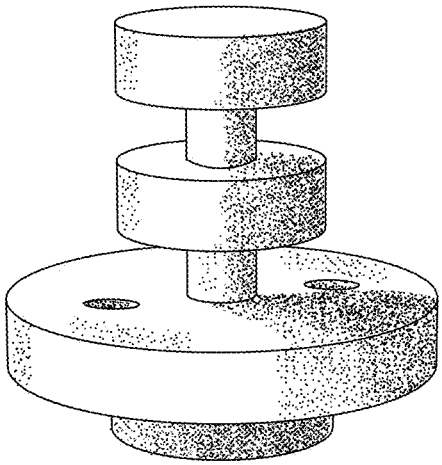
FIG. 52 illustrates an aesthetic view of the vortexer of FIG. 38.

In an effort to improve the generation of a vortex airflow, the present disclosure relates to a vortexer for a cap of the personal vaporizer. The vortexer may be accommodated within the cap of the personal vaporizer. Further, the vortexer may include at least one inlet configured to generate a vortex airflow with an inhalation action created by the user. The present disclosure explains the vortexer in detail, in conjunction with FIGS. 1-52.

Figure 1:
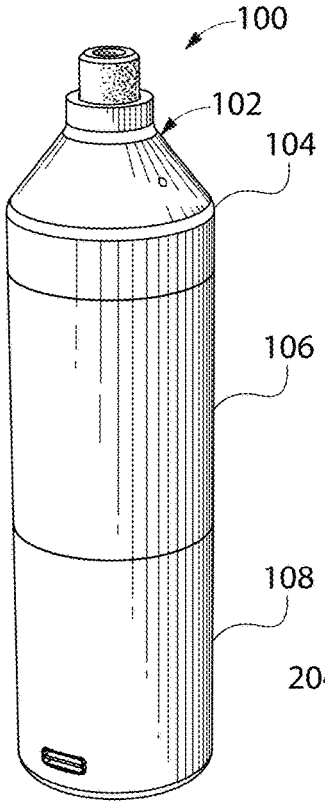
FIG. 1 illustrates a perspective view of a personal vaporizer.

FIG. 1 illustrates a perspective view 100 of a personal vaporizer 102. The personal vaporizer 102 may include a cap 104, a heating pod 106, and a power source 108. The heating pod 106 may be configured to accommodate and heat a vaporizer product such as e-liquid or vape juice. The vaporizer product may be heated by a heating mechanism in the heating pod 106 (such as heating coils, not shown herein) by using electrical power from the power source 108. Further, the user may be configured to create an inhalation, or a "sucking" action at the cap 104, which may generate a vortex airflow that mixes with the vapors emitted by heating the vaporizer product. The vortex airflow is generated using a vortexer accommodated within the cap 104. The vortexer is explained in detail hereon.

Figure 2:
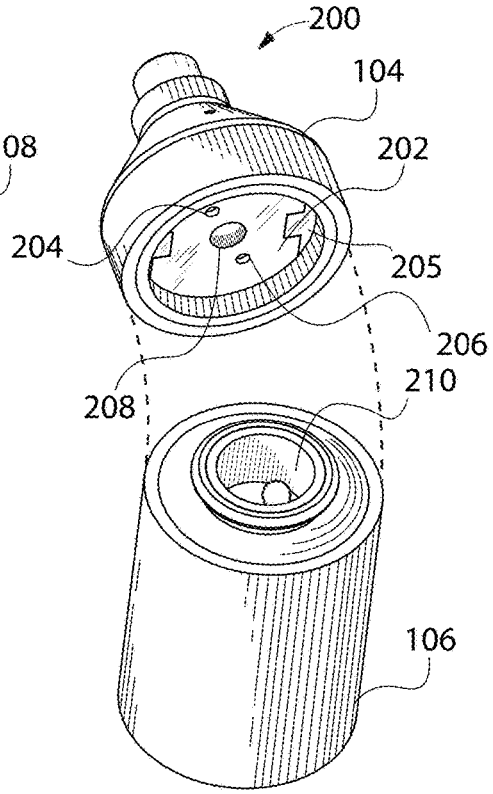
FIG. 2 illustrates a cap disconnected from a pod of the personal vaporizer of FIG. 1.
Figure 3:
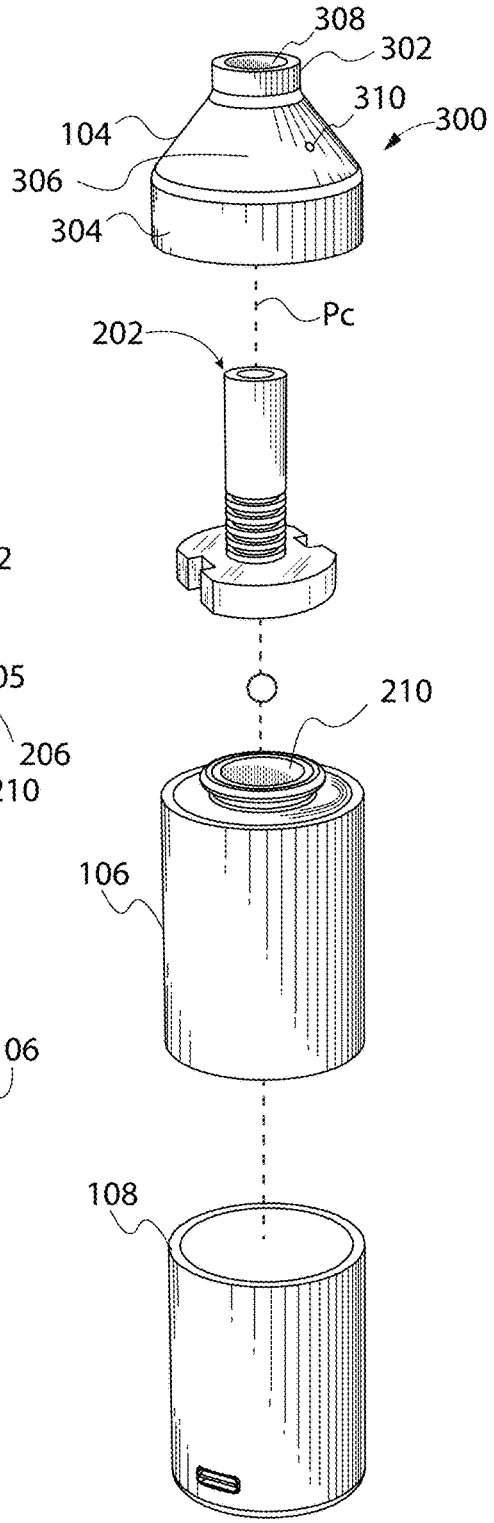
FIG. 3 illustrates an exploded view of the personal vaporizer of FIG. 1.

FIG. 2 illustrates a schematic 200 of a cap 104 disconnected from the heating pod 106 of the personal vaporizer 102 of FIG. 1, and FIG. 3 illustrates an exploded view 300 of the personal vaporizer 102 of FIG. 1.

As explained earlier, the cap 104 may be configured to accommodate a vortexer 202. The cap 104 and the vortexer 202 may be assembled to form a mouthpiece of the personal vaporizer 102. Furthermore, the vortexer 202 may be accommodated within the cap 104 with various techniques, such as but not limited to snap-fitting, push-fitting, and the like. Alternatively, the vortexer 202 may be formed with the cap 104 as a singular structure. Further, the cap 104 may be adjoined to the heating pod 106 using a snap-fit arrangement, or fastened together using screw threads, and the like. Furthermore, the heating pod 106 may be connected to the power source 108 using similar methods.

The cap 104 may include a proximal cap end 302, and a distal cap end 304 oppositely formed to the proximal cap end 302. Further, the cap 104 may include an outer cap surface 306 formed between the proximal cap end 302 and the distal cap end 304. Further, the cap 104 may include an inner cap surface 308 configured to interface with the vortexer 202. Further, the cap 104 may include one or more cap inlets 310 running throughout the outer cap surface 306 and the inner cap surface 308. The one or more cap inlets 310 may be configured to draw air surrounding the personal vaporizer 102 within a space between the inner cap surface 308 and the vortexer 202.

The vortexer 202 may include a first inlet 204, a second inlet 206, and a central outlet 208 disposed between the first inlet 204 and the second inlet 206. It must be noted that when the cap 104 may be connected to the heating pod 106, the vortexer 202 may be disposed above, and vertically separated by a predefined gap from a heating chamber 210 of the heating pod 106. The heating chamber 210 may be configured to accommodate and heat the vaporizer product. The vapors of the vaporizer product emitted from the heating chamber 210 may be mixed with a vortex airflow created by the first inlet 204 and the second inlet 206. After mixing with the vortex airflow, a fluid mixture may be formed which may exit the vortexer 202 from the central outlet 208. The various configurations of the vortexer 202 are illustrated in detail, hereinafter.

Figure 4:
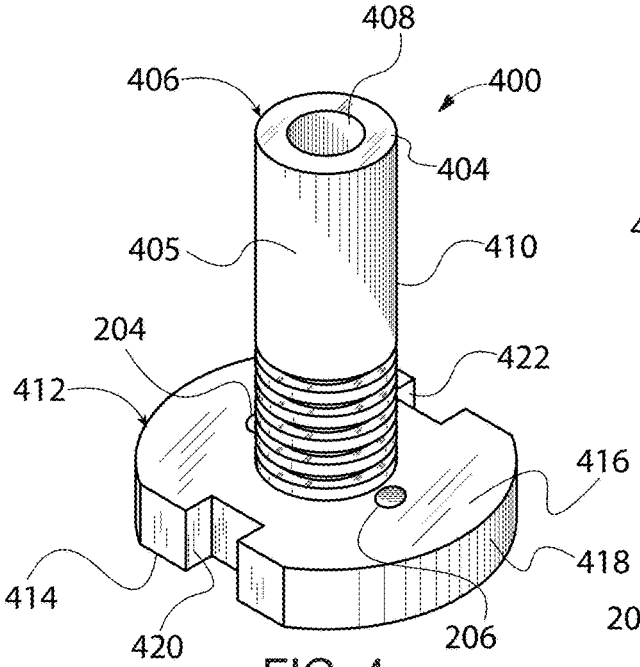
FIG. 4 illustrates a perspective view of a vortexer.
Figure 5:
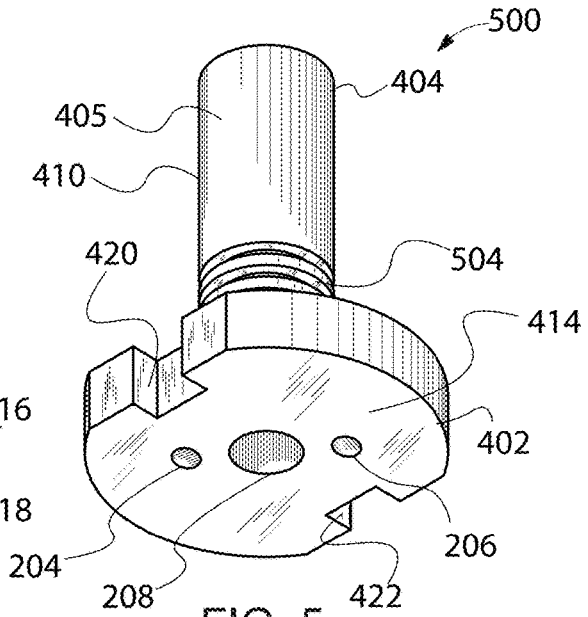
FIG. 5 illustrates a bottom-perspective view of the vortexer of FIG. 4.

FIG. 4 illustrates a perspective view 400 of a vortexer 202, and FIG. 5 illustrates a bottom-perspective view 500 of a vortexer 202. The vortexer 202 may include a proximal end 402 configured to adjoin to the heating pod 106 of the personal vaporizer 102, and a distal end 404 which may protrude from the proximal cap end 302. The distal end 404 may emerge from the inner cap surface 308 and the proximal cap end 302 and may be configured to interface with the mouth of the user. The vortexer 202 may further include a tube 406 protruding between the proximal end 402 and the distal end 404. The tube 406 may define a central axis $P_c$ (refer to FIG. 3), which may coincide with a central axis of the cap 104. Further, the tube 406 may include an inner wall 408 concentrically formed about the central axis $P_c$. The vortexer 202 may further include an outer wall 410 concentrically formed about the central axis $P_c$. Further, the vortexer 202 may include a shoulder 412 protruding from the proximal end 402 towards the distal end 404. The shoulder 412 may include a bottom face 414 co-planar to the proximal end 402 of the vortexer and perpendicular to the central axis $P_c$, and a top face 416 parallel to and offset from the bottom face 414. The top face 416 may be perpendicular to the central axis $P_c$. Further, the shoulder 412 may include an outer perimeter 418 concentrically formed about the central axis $P_c$ between the bottom face 414 and the top face 416. It must be noted that the tube 406 may be formed as a single product with the shoulder 412, or may be separately manufactured and adjoined to the shoulder 412.

In an illustrative configuration, the shoulder 412 may further include a first detent 420 and a second detent 422 formed in the outer perimeter 418. The second detent 422 may be oppositely disposed from the first detent 420. The first detent 420 and the second detent 422 may include a locking detent, such as but not limited to a circular slot, a square slot, and the like. Further, the first detent 420 and the second detent 422 are configured to axially align the vortexer 202 relative to the cap 104. Particularly, the first detent 420 and the second detent 422 may be configured to engage with one or more lock tabs (not shown) in the proximal cap end 302 to align and lock the vortexer 202 within the cap 104. Moreover, a sealant 205 (refer to FIG. 2) may be disposed between the shoulder 412 and the proximal cap end 302. The sealant 205 may be configured to seal the shoulder 412 and the proximal cap end 302, thereby preventing any passage of air therebetween.

As explained earlier, the heating chamber 210 may be configured to accommodate and heat the vaporizer product, which as a result, may produce vapors at a high temperature that may contact the vortexer 202. Such vapors, upon contact, may cause overheating of the vortexer 202, which may be made of metals such as but limited to stainless steel, titanium dioxide, aluminum, and the like. The overheating of the vortexer 202 may also cause a burning effect in the mouth of the user during the inhalation action, especially when the mouth of the user interfaces with the distal end 404 of the vortexer 202. Therefore, to prevent overheating and ensure that the vortexer 202 may operate within thermal limits, a heat-convector and an insulated coating 405 may be formed on the vortexer 202. This is explained in FIG. 5.

Figure 6:
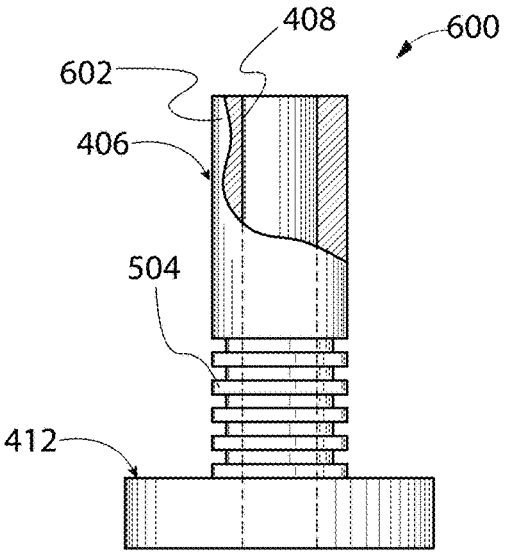
FIG. 6 illustrates a sectional view of the vortexer of FIG. 4.

FIG. 6 illustrates a partial sectional view 600 of the vortexer 202. The tube 406 of the vortexer 202 herein, may further include a mouth portion 602 at the distal end 404. The mouth portion 602 may be configured to interface with the mouth of the user. The mouth portion 602 may include an insulated coating 405. Alternatively, the insulated coating 405 may be formed throughout the length of the tube 406. The insulated coating 405 may be formed with, but not limited to, at least a metal coating dissimilar to a composition of the tube, a polymer resin, an insulated texture, and the like. Moreover, the insulated coating 405 formed on the mouth portion 602 with manufacturing processes such as but not limited to spray-coating, dipping in a liquid insulation solution, brushing, and the like. The insulated coating 405 ensures that the mouth portion 602 may not overheat due to overheating of the vortexer 202, thereby preventing burns on the mouth of the user.

With continued reference to FIG. 6, the tube 406 may further include a heat-convector 504 formed between the top face 416 and the insulated coating 405. Alternatively, the heat-convector 504 may be formed throughout the length of the tube 406. The heat-convector 504 may be formed as at least one circumferential fin formed on the outer wall 410. In the case of the heat-convector 504 formed throughout the length of the tube 406, the heat-convector 504 may include a plurality of radial flanges formed on the length of the tube 406. The heat-convector 504 may be configured to absorb and transmit excess heat resulting from the overheating of the vortexer 202, through the outer wall 410 using convection mode of heat transfer. The transmitted heat may be trapped within the cap 104, and may eventually heat the surrounding airflow which may be transformed into the vortex airflow using the first inlet 204, and the second inlet 206.

The first inlet 204 and the second inlet 206 may be configured to generate the vortex airflow. The first inlet 204 and the second inlet 206 may be designed radially-offset from, nonparallel-to, and non-intersecting the central axis $P_c$. Particularly, the first inlet 204 defines a first inlet axis. The first inlet axis is radially-offset from, nonparallel-to, and non-intersecting with the central axis $P_c$ by a first predefined angle. Moreover, the second inlet 206 defines a second inlet axis. The second inlet axis is radially-offset-from, nonparallel-to, non-intersecting the central axis $P_c$ by a second predefined angle. The configurations of the first inlet axis and the second inlet axis are illustrated in detail, in conjunction with FIGS. 7-13.

Figure 7:
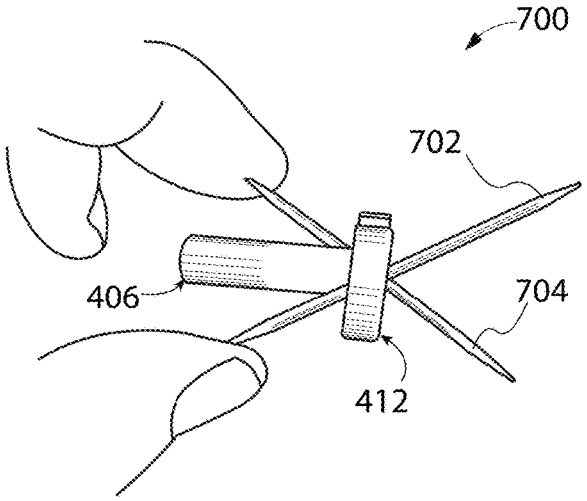
FIG. 7 illustrates a schematic explaining configurations of the first inlet axis and the second inlet axis.

FIG. 7 is an illustrative schematic 700 representing one configuration of the first inlet axis and the second inlet axis. As explained earlier, the first inlet axis and the second inlet axis are defined by the first inlet 204 (FIG. 2) and the second inlet 206 (FIG. 2) respectively, and may be concentrically opposite or non-eccentric to each other. Particularly, the second inlet axis is concentrically opposite to the first inlet axis. In other words, the first inlet axis may appear to be transposed to the second inlet axis about a common center. This is visualized clearly in the schematic 700, in which a first elongated member 702 may pass through the first inlet axis, and a second elongated member 704 may pass through the second inlet axis. As seen, the first elongated member 702 may appear transposed or distinctively oriented to the second elongated member 704 about a common center (which may be the shoulder 412). Such transposed configuration of the first inlet 204 and the second inlet 206, along with being radially-offset from, nonparallel-to, non-intersecting the central axis $P_c$ may enable generation of the vortex airflow. The configuration of the first inlet 204, and the second inlet 206 is explained in conjunction with FIGS. 8-13.

Figure 8:
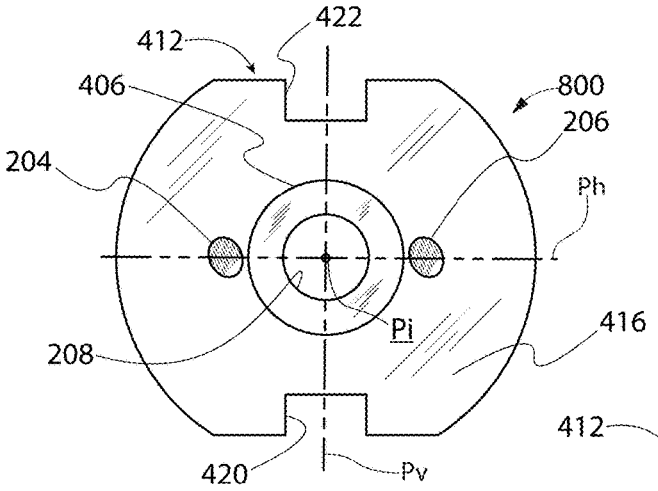
FIG. 8 illustrates a top view of the vortexer.
Figure 9:
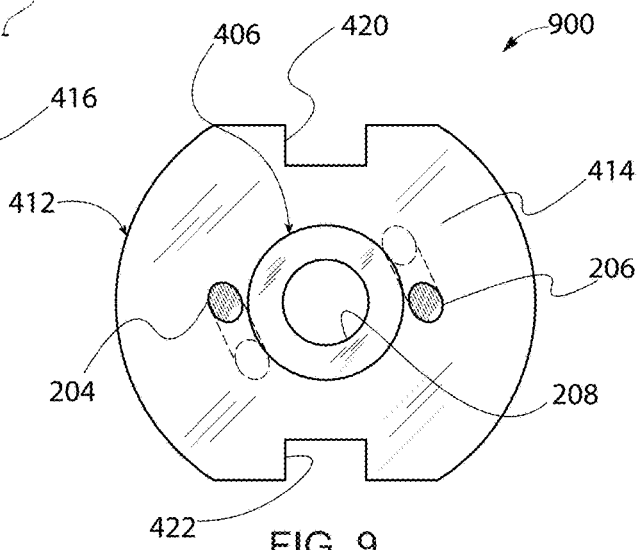
FIG. 9 illustrates a bottom view of the vortexer.

FIG. 8 illustrates a top view 800 of the vortexer 202, and FIG. 9 illustrates a bottom view 900 of the vortexer 202. Referring to the top view 800, the first inlet 204 and the second inlet 206 may be formed along a horizontal axis $P_h$. Further, the first detent 420 and the second detent 422 may be formed along a vertical axis $P_v$. As such, in some configurations, the first inlet 204 and the second inlet 206 may be interchangeably formed along the vertical axis $P_v$, and the first detent 420 and the second detent 422 may be formed along the horizontal axis $P_h$.

With continued reference to FIGS. 8-9, the first inlet 204 and the second inlet 206 may be formed as an elliptical-shaped groove, progressing from the bottom face 414 to the top face 416. Moreover, the first inlet 204 and the second inlet 206 may not intersect the central axis $P_c$. The central axis $P_c$ may pass through, and may be perpendicular to a point of intersection of the vertical axis $P_v$ and the horizontal axis $P_h$. Therefore, the intersection of the first inlet 204 and the second inlet 206, or the intersection of the first inlet 204 and the second inlet 206 with the central outlet 208 may be prevented. Hence, the first inlet 204 and the second inlet 206 may be separated from the central outlet 208, which also results in an efficient generation of the vortex airflow.

To prepare an effective vortex airflow, in addition to the non-intersection of the first inlet and the second inlet with the central outlet, the first inlet the first inlet 204, and the second inlet 206 may be radially offset from the central axis $P_c$ by a predefined angle. This is explained in conjunction with FIG. 10.

Figure 10:
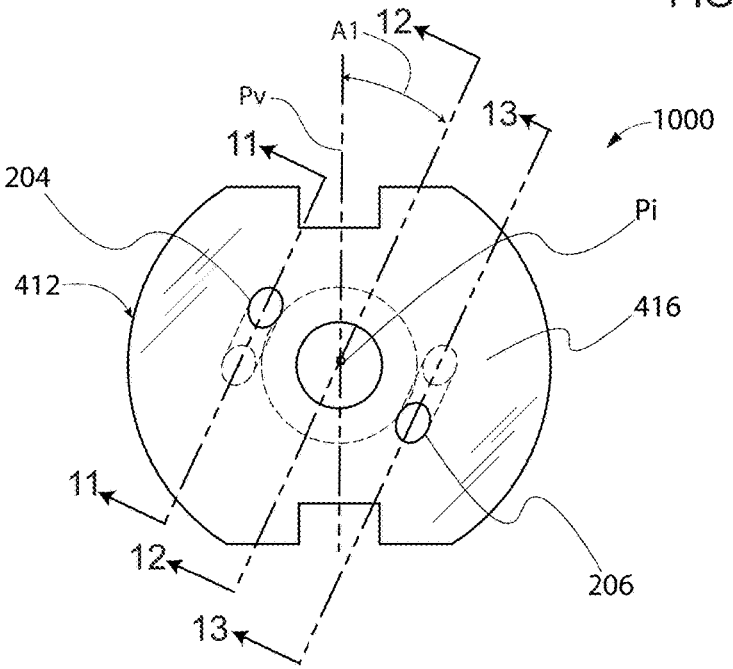
FIG. 10 illustrates another bottom view of the vortexer.

FIG. 10 illustrates another bottom view 1000 of the vortexer 202. As described herein, axis 11-11 may define a section of the vortexer 202 along the first inlet 204, and axis 13-13 may define a section of the vortexer 202 along the second inlet 206. Further, as seen in the bottom view 1000, an axis 12-12 may define a section along the central outlet. It must be noted that the axis 11-11, the axis 12-12, and the axis 13-13 are co-parallel, i.e., parallel and mutually equidistant. Therefore, the sections defined herein, by each of the axis 11-11, the axis 12-12, and the axis 13-13 respectively are mutually parallel and equidistant by a predefined distance, which may include for example, an outer diameter of the tube 406.

As explained earlier, the vortexer 202 and the first inlet 204 may be radially offset from a central axis $P_c$ by a predefined angle. For example, the first inlet 204 may be radially offset, or radially run out from the central axis $P_c$ by a predefined angle A1. Similarly, the second inlet 206 may be radially offset, or radially run out from the central axis $P_c$ by a predefined angle A1. In some implementations, the predefined angle A1 may range from 5 to 85 degrees, in other implementations a range of 30 to 60, and in one specific configuration 30 degrees plus/minus 5 degrees. As such, in some configurations, the angle A1 is measured as an angle subtended by the section defined by axis 12-12 on a point $P_i$, which may be a point of intersection of the axis 12-12, the central axis $P_c$, and the vertical axis $P_v$. Further, as the section defined by the axis 12-12 is parallel to the section defined by the axis 11-11 and the section defined by the axis 13-13, the orientation of the axis 12-12 may be similar to the orientation of the axis 11-11 and the axis 13-13. This orientation of the axis 12-12, when measured relative to the vertical axis $P_v$, may determine the angle subtended by the axis 12-12 on the point $P_i$. Therefore, the extent of inclination of the axis 12-12 may indicate the first inlet 204 and the second inlet 206 being inclined or radially offset to or run out from the central axis $P_c$ by the predefined angle A1. This may result in a symmetrical orientation of the first inlet 204 and the second inlet 206 within the vortexer 202 (when viewed relative to the vertical axis $P_v$). As a result, a symmetrical chamber geometry of the vortexer 202 may be formed, which eventually may result in a proper formation of the vortex airflow.

In addition to being non-intersecting and radially offset to the central axis $P_c$, the first inlet 204 and the second inlet 206 as explained earlier may also be non-parallel to the central axis $P_c$. Particularly, the first inlet 204 and the second inlet 206 may also be inclined longitudinally by a predefined angle from the central axis $P_c$. This is explained in detail, in conjunction with FIGS. 11-13.

Figure 11:
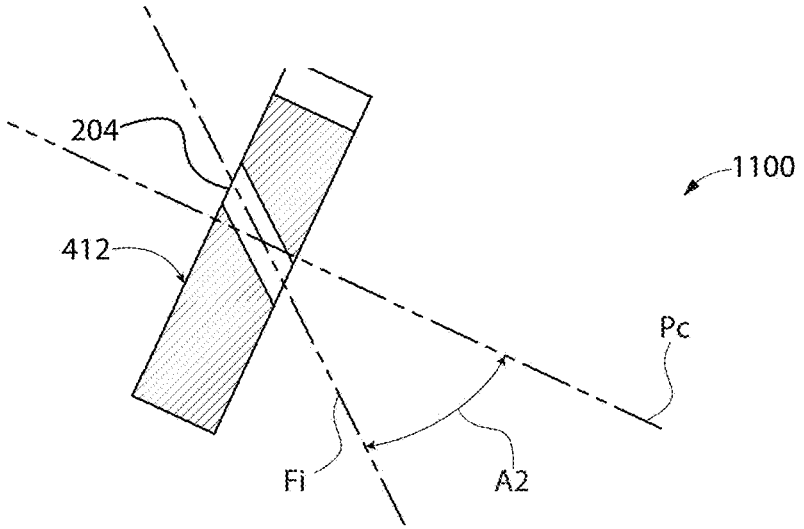
FIG. 11 illustrates a sectional view of the vortexer along an axis 11-11 in FIG. 10.
Figure 12:
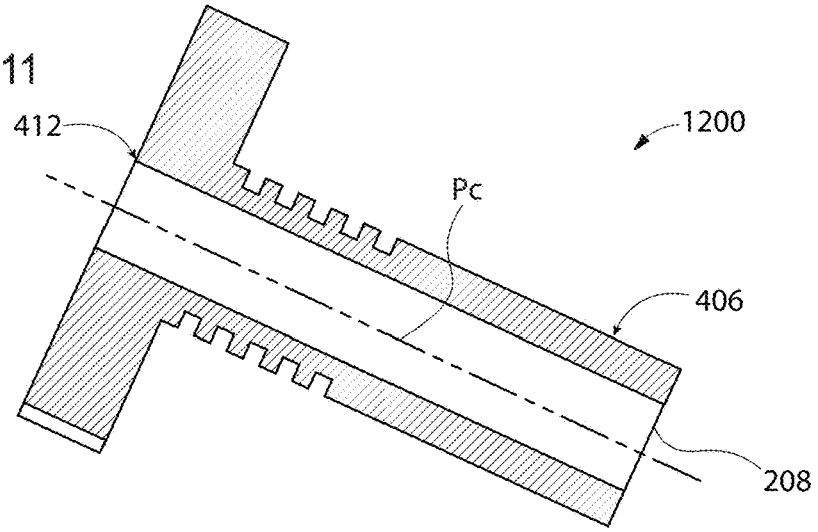
FIG. 12 illustrates a sectional view of the vortexer along an axis 12-12 in FIG. 10.
Figure 13:
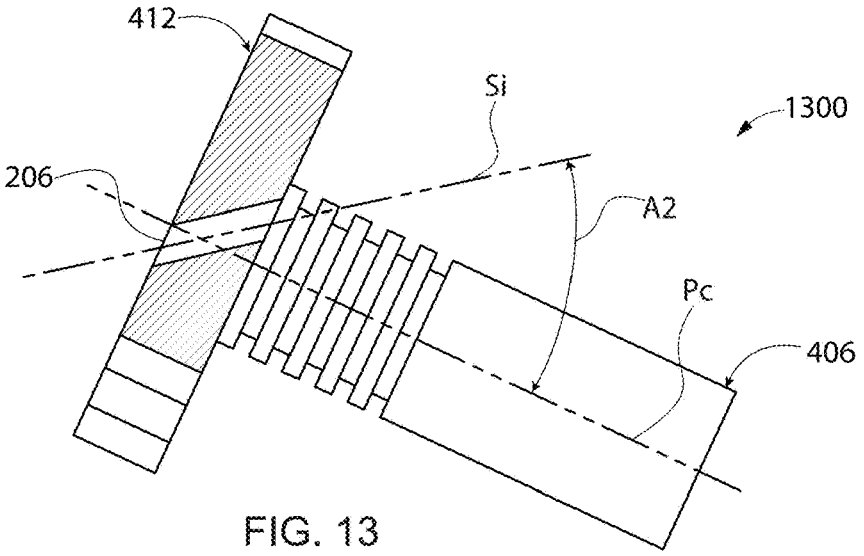
FIG. 13 illustrates a sectional view of the vortexer along the axis 13-13 in FIG. 10.

FIG. 11 illustrates a sectional view 1100 of the vortexer 202 along the axis 11-11, FIG. 12 illustrates a sectional view 1200 of the vortexer 202 along the axis 12-12, and FIG. 13 illustrates a sectional view 1300 of the vortexer 202 along the axis 13-13.

With continued reference to FIGS. 11-13, the central axis $P_c$ can be seen as the axis passing longitudinally, and through the center of the vortexer 202. Moreover, the first inlet axis Fi may define the axis of the first inlet 204, and a second inlet axis Si may define the axis of the second inlet 206. The first inlet axis Fi may pass through the first inlet 204 and the second inlet axis Si may pass through the second inlet 206.

In an illustrative configuration, with continued reference to FIG. 11, the first inlet axis Fi may be oriented relative to the central axis $P_c$ by a predefined angle A2. The predefined angle A2 herein may be measured in a clockwise direction from the central axis $P_c$. Similarly, the second inlet axis Si may be oriented relative to the central axis $P_c$ by a predefined angle A2'. It must be noted that the angle A2' herein may be measured in a counterclockwise direction from the central axis $P_c$. The magnitude of the predefined angle A2' may be similar to the magnitude of the predefined angle A2. Hence, the first inlet axis Fi and the second inlet axis Si may be symmetrically oriented about the central axis $P_c$. As may be appreciated, the symmetric orientation of the first inlet axis Fi and the second inlet axis Si relative to the central axis $P_c$ may demonstrate the symmetric orientation of the first inlet 204 and the second inlet 206 relative to the central outlet. In some configurations the predefined angle A2 may be between five and eight-five degrees, while in another configuration it may be 30 to 60 degrees, and it may be 35 degrees plus or minus 5 degrees.

Figure 14:
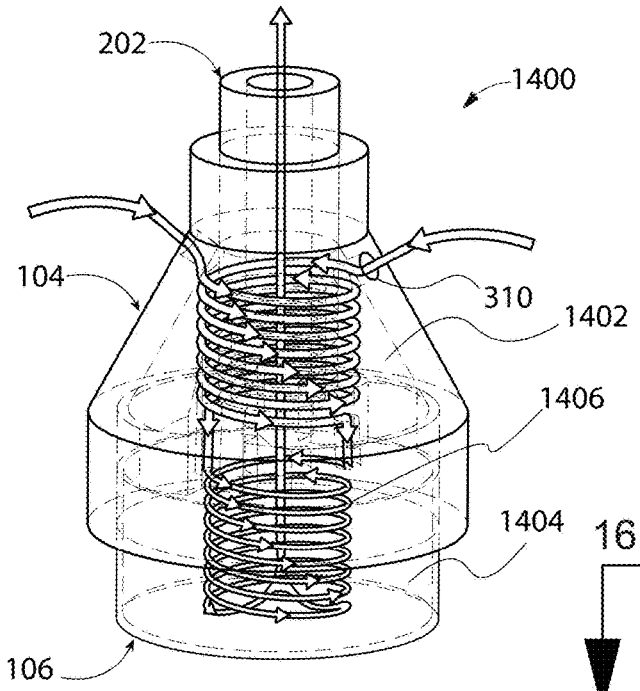
FIG. 14 illustrates a perspective view of a top portion of the personal vaporizer.

FIG. 14 illustrates a perspective view 1400 of a top portion of the personal vaporizer 102, illustrating the formation of the vortex airflow therein. As such, in some configurations, a first chamber 1402 may be formed between an inner cap surface and the outer wall 410 surrounding the tube 406, and a second chamber 1404 may be formed between the heating pod 106 and the vortexer 202.

In an illustrative configuration, the vortex airflow may be created when the user creates an inhalation action at the distal end 404. When the inhalation action is initiated, a vacuum may be generated within the first chamber 1402 and the second chamber 1404. Consequently, the air surrounding the cap 104 may enter the first chamber 1402 via one or more cap inlets 310 in a streamline flow or a vortex flow (as indicated by an indicia 1406). The air in the first chamber 1402 may progress via the first inlet 204 and the second inlet 206 into the second chamber 1404. As explained earlier, the air exiting the first inlet 204 and the second inlet 206 may be configured to be formed as a vortex airflow. Particularly, the vortex airflow may be generated in the second chamber 1404.

The second chamber 1404 herein may be formed between the shoulder 412 of the vortexer 202 and the heating pod 106. As the vortex airflow may be formed in the second chamber 1404, consequently, the vortex airflow may be generated above the heating pod 106. The vortex airflow may be configured to be mixed with the vapors generated in the heating pod 106, which is explained in conjunction with FIGS. 15-16.

Figure 15:
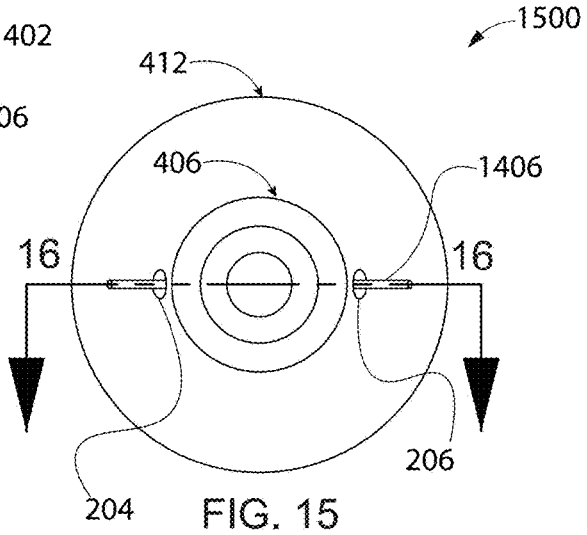
FIG. 15 illustrates a sectional top view of the vortexer.
Figure 16:
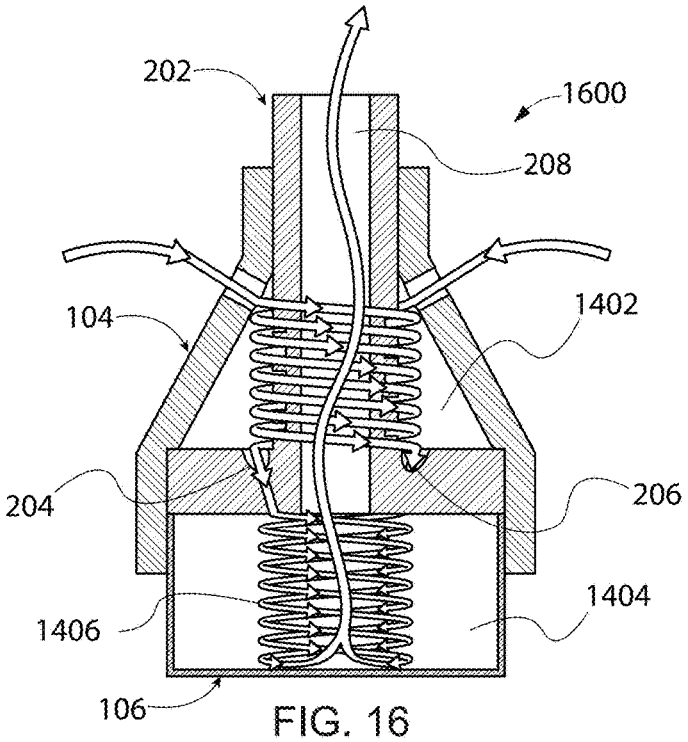
FIG. 16 illustrates a sectional view of the vortexer taken along sections 16-16 in FIG. 15.

FIG. 15 illustrates a sectional top view 1500 of the vortexer 202 illustrating transmission of the air from the first chamber 1402 to the second chamber 1404, and FIG. 16 illustrates a sectional view 1600 of the vortexer 202 taken along the section 16-16 in FIG. 15.

As explained earlier, the air may enter the second chamber 1404 from the first chamber 1402 to be reformed as the vortex airflow by the first inlet 204 and the second inlet 206 over the heating pod 106. Therefore, the vortex airflow may be configured to mix with the vapors of the vaporizer product generated by the heating pod 106. The resulting mixture of the vapors with the vortex airflow may be further transmitted to the distal end 404 via the central outlet 208, towards the mouth of the user.

Figure 17:
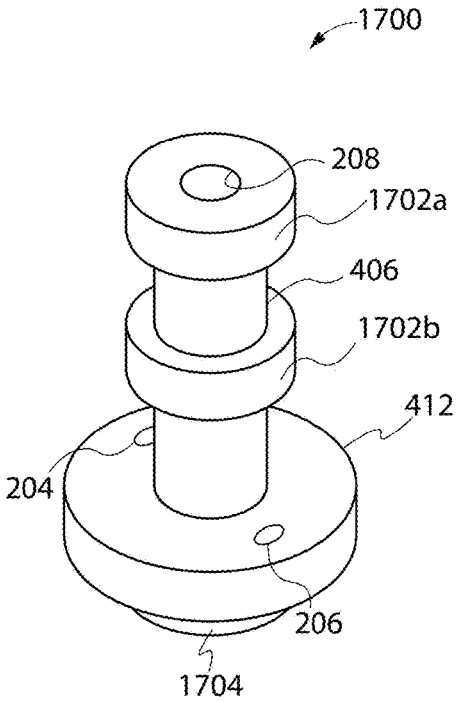
FIG. 17 illustrates a perspective view of another configuration of the vortexer.
Figure 18:
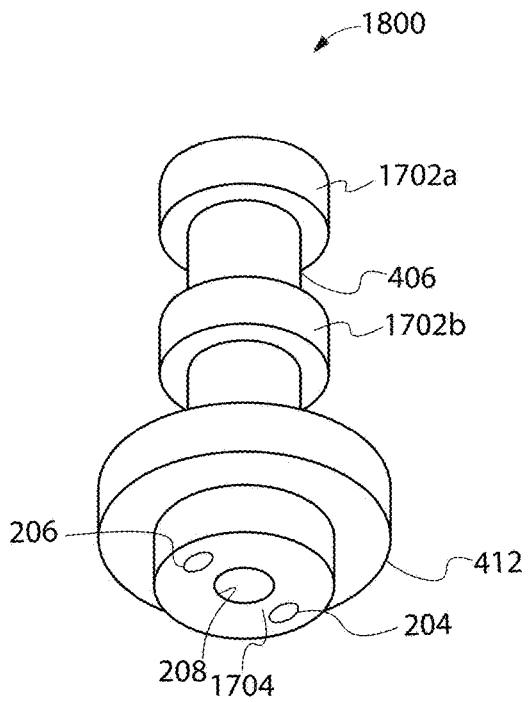
FIG. 18 illustrates a bottom perspective view of a vortexer of FIG. 17.
Figure 19:
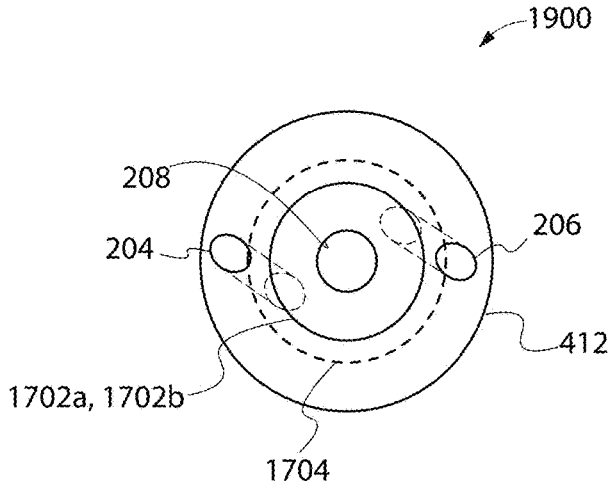
FIG. 19 illustrates a top view of the vortexer of FIG. 17.
Figure 20:
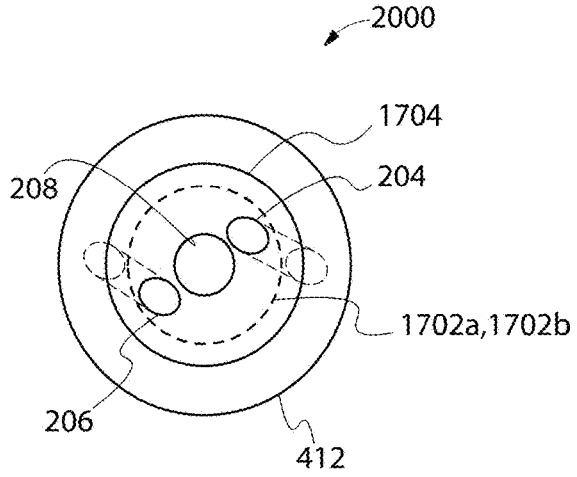
FIG. 20 illustrates a bottom view of the vortexer of FIG. 17.
Figure 21:
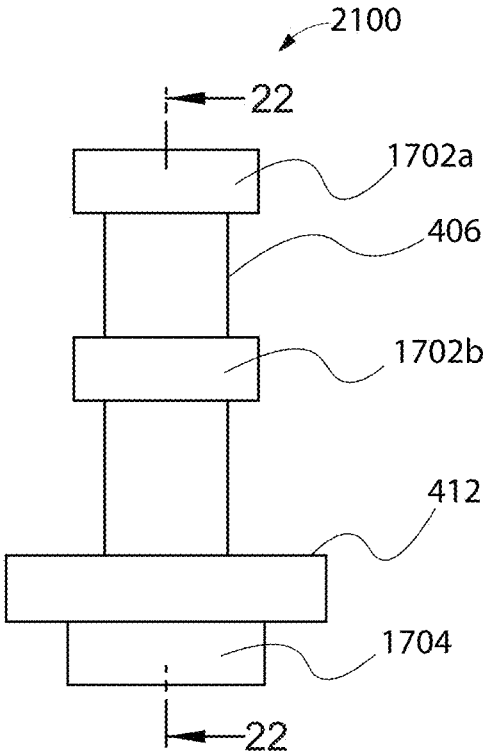
FIG. 21 illustrates a front view of the vortexer of FIG. 17.
Figure 22:
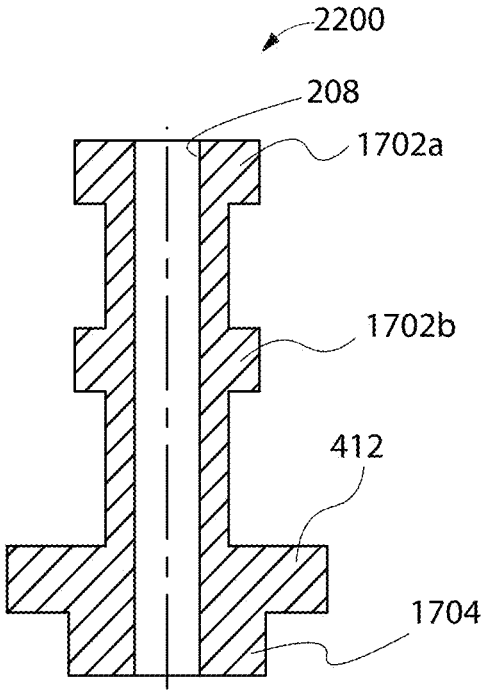
FIG. 22 illustrates a sectional view taken along axis 22-22 of the vortexer of FIG. 17.

In an alternative configuration, FIG. 17 illustrates a perspective view 1700 of another configuration of the vortexer 202, FIG. 18 illustrates a bottom perspective view 1800 of a vortexer 202 of FIG. 17, FIG. 19 illustrates a top view 1900 of the vortexer 202 of FIG. 17, FIG. illustrates a bottom view 2000 of the vortexer 202 of FIG. 17, FIG. 21 illustrates a front view 2100 of the vortexer of FIG. 17, and FIG. 22 illustrates a sectional view 2200 taken along axis 22-22 of the vortexer of FIG. 17.

In an alternative configuration, the vortexer 202 may include an extended base 1704 protruding vertically downwards from the shoulder 412. The extended base 1704 may be formed of a diameter smaller than a diameter of the shoulder 412. Preferably, the diameter of the extended base 1704 may be similar to a diameter of the heating chamber 210. As such, the extended base 1704 may be configured to engage the heating chamber 210 as the cap 104 is assembled to the heating pod 106.

It must be noted that conventional personal vaporizers also suffer from the disadvantage of the buildup of vapors above, or close to the heating chamber. Accordingly, the generation of the vortex airflow may be obstructed by the buildup of vapors. To ensure proper generation of the vortex airflow, the cap along with the vortexer may be disengaged repeatedly from the heating chamber after every session to remove the buildup of the vapors. Hence, the vortexer 202 of FIG. 17 may include a central outlet 208 which may act as a carb, i.e., a groove designed to mix the buildup of the vapors with the vortex airflow when the personal vaporizer 102 may not be activated, and the buildup of the vapors may be removed without the removal of the cap 104. Accordingly, when not activated, the personal vaporizer 102 may be activated to generate the vortex airflow via the first inlet 204 and the second inlet 206.

In an alternative configuration, the vortexer 202 may also include a plurality of discs or flanges formed on the outer surface of the tube 406. The plurality of the discs may include a first disc 1702*a* and a second disc 1702*b*. The plurality of discs may be configured to act as the heat convector (similar to heat-convector 504) or may be configured to dissipate heat from the vortexer 202.

Figure 23:
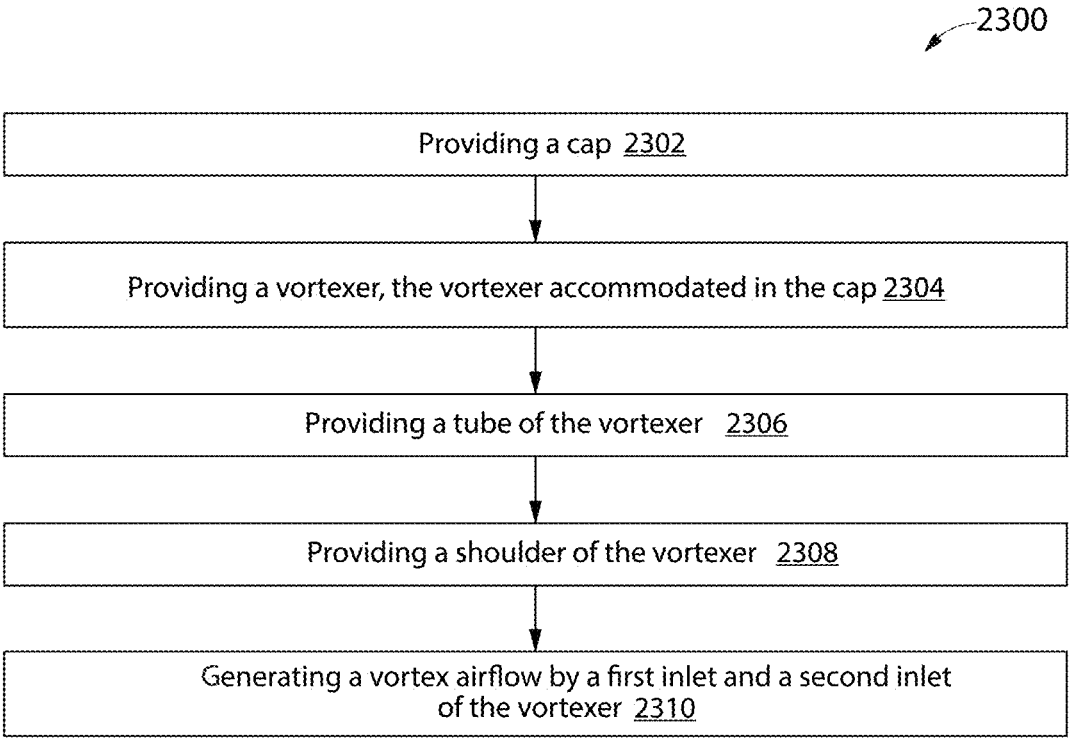
FIG. 23 illustrates an airflow generation method for generation of a vortex airflow on the personal vaporizer.
Figure 24:
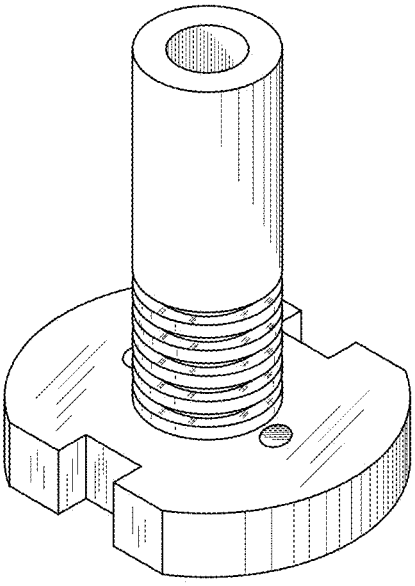
FIG. 24 illustrates a perspective view of a vortexer.
Figure 25:
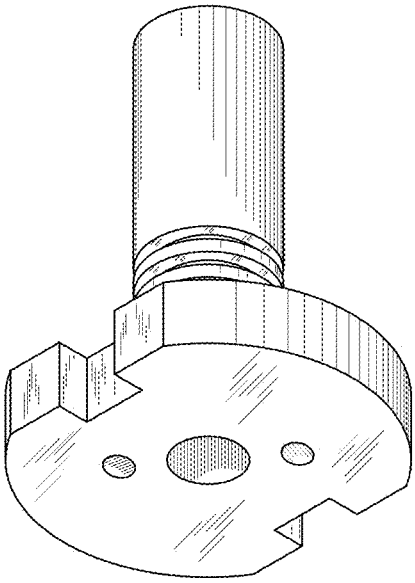
FIG. 25 illustrates a bottom perspective view of a vortexer of FIG. 18.
Figure 26:
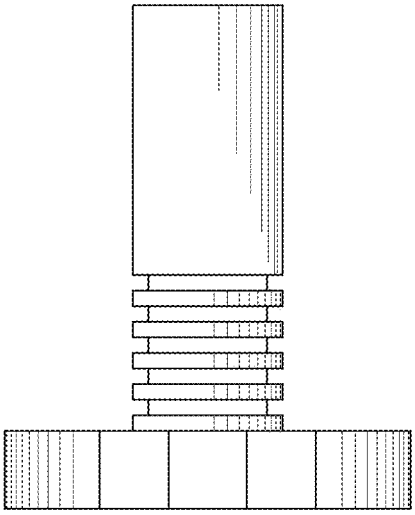
FIG. 26 illustrates a front view of the vortexer of FIG. 18.
Figure 27:
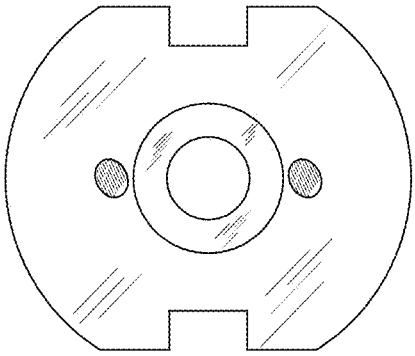
FIG. 27 illustrates a top view of the vortexer of FIG. 18.
Figure 28:
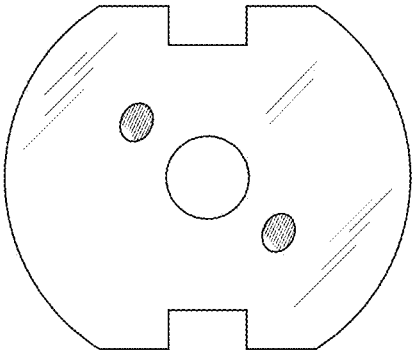
FIG. 28 illustrates a bottom view of the vortexer of FIG. 18.
Figure 29:
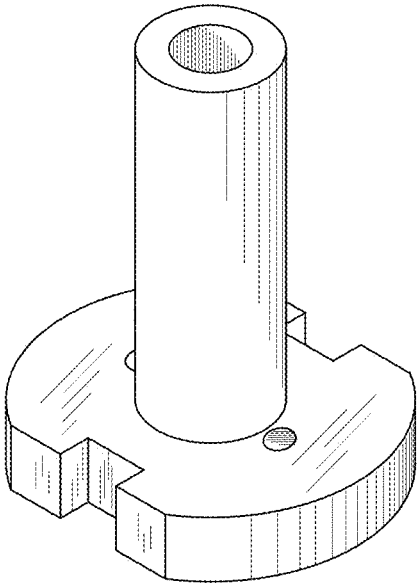
FIG. 29 illustrates a perspective view of another configuration of the vortexer.
Figure 30:
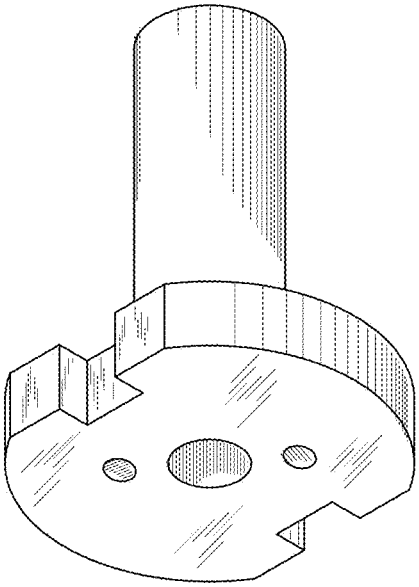
FIG. 30 illustrates a bottom perspective view of a vortexer of FIG. 23.
Figure 31:
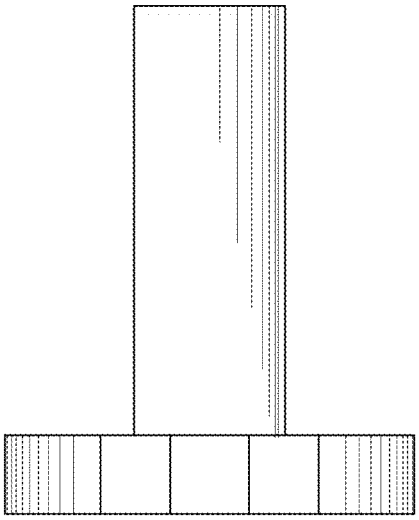
FIG. 31 illustrates a front view of a vortexer of FIG. 23.
Figure 32:
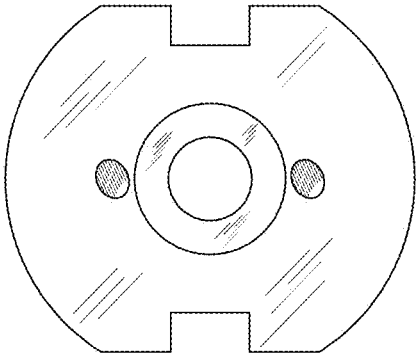
FIG. 32 illustrates a top view of the vortexer of FIG. 23.
Figure 33:
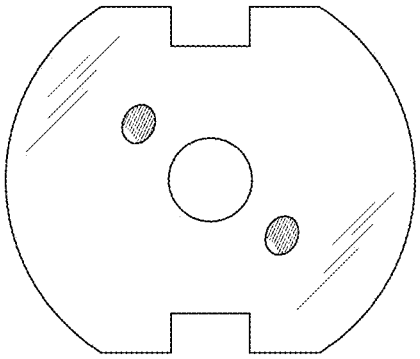
FIG. 33 illustrates a bottom view of the vortexer of FIG. 23.
Figure 34:
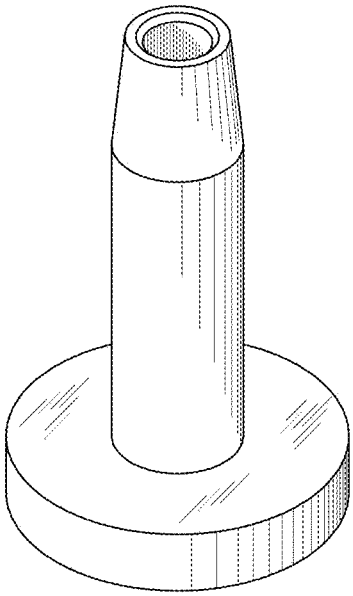
FIG. 34 illustrates a perspective view of another configuration of the vortexer.
Figure 35:
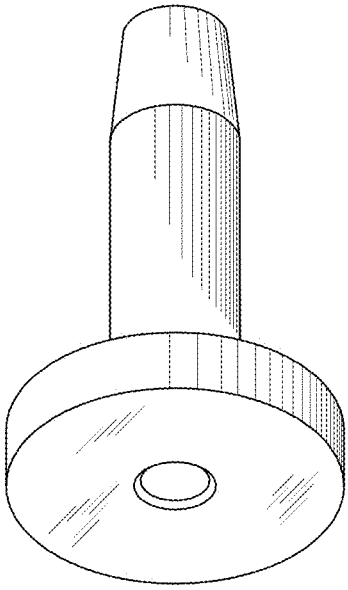
FIG. 35 illustrates a bottom perspective view of a vortexer of FIG. 28.
Figure 36:
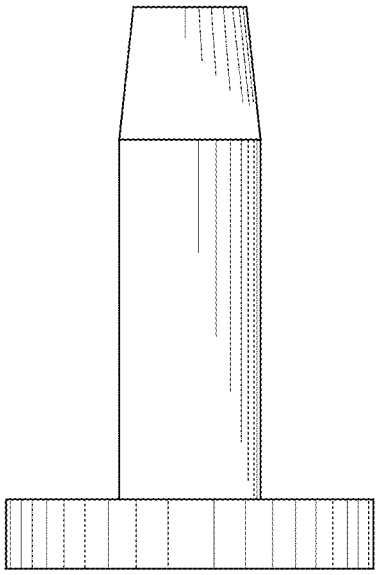
FIG. 36 illustrates a front view of a vortexer of FIG. 28.
Figure 37:
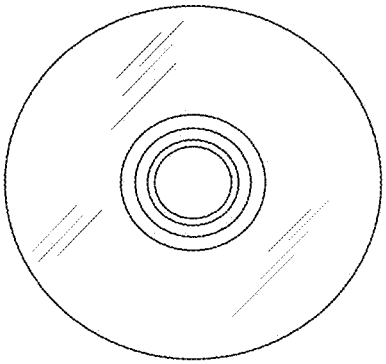
FIG. 37 illustrates a top view of the vortexer of FIG. 28.
Figure 38:
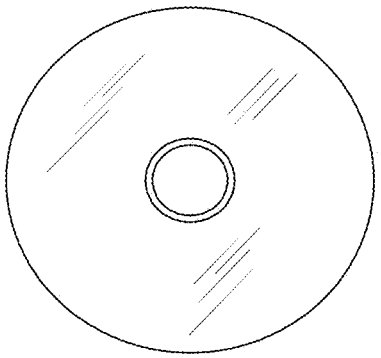
FIG. 38 illustrates a bottom view of the vortexer of FIG. 28.
Figure 39:
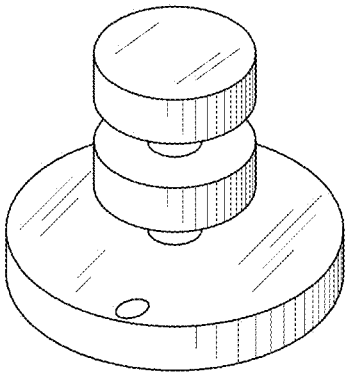
FIG. 39 illustrates a perspective view of another configuration of the vortexer.
Figure 40:
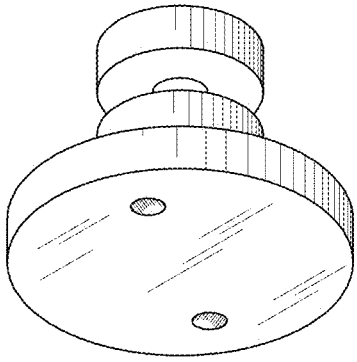
FIG. 40 illustrates a bottom perspective view of a vortexer of FIG. 33.
Figure 41:
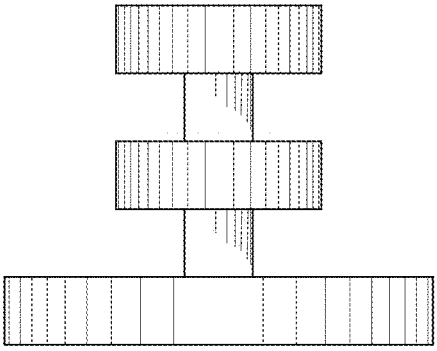
FIG. 41 illustrates a front view of a vortexer of FIG. 33.
Figure 42:
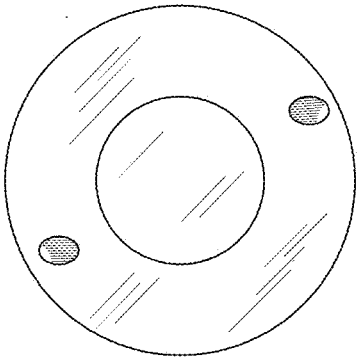
FIG. 42 illustrates a top view of the vortexer of FIG. 33.
Figure 43:
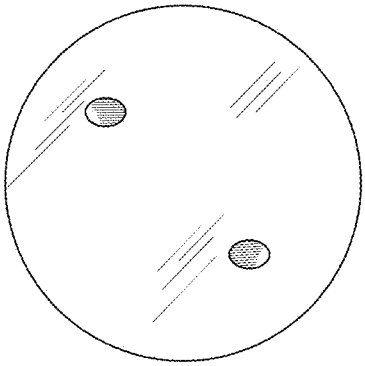
FIG. 43 illustrates a bottom view of the vortexer of FIG. 33.
Figure 44:
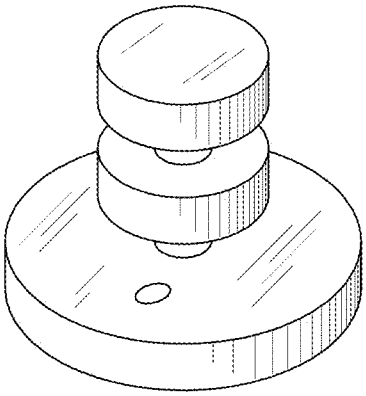
FIG. 44 illustrates a perspective view of another configuration of the vortexer.
Figure 45:
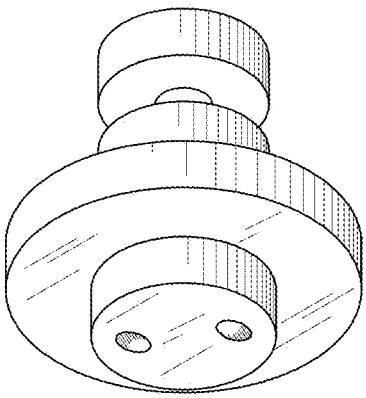
FIG. 45 illustrates a bottom perspective view of a vortexer of FIG. 38.
Figure 46:
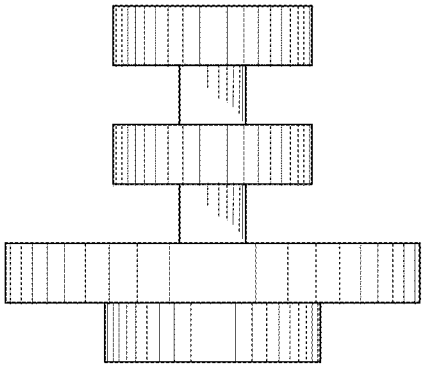
FIG. 46 illustrates a front view of a vortexer of FIG. 38.
Figure 47:
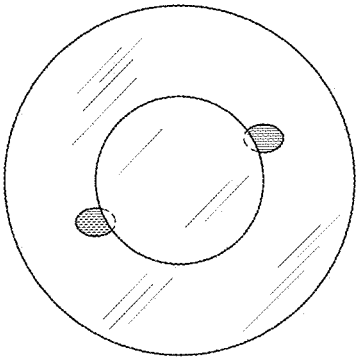
FIG. 47 illustrates a top view of the vortexer of FIG. 38.
Figure 48:
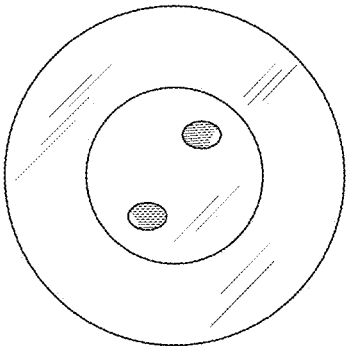
FIG. 48 illustrates a bottom view of the vortexer of FIG. 38.
Figure 49:
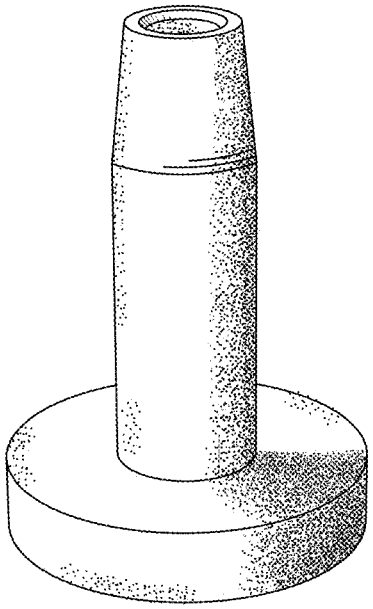
FIG. 49 illustrates an aesthetic view of the vortexer of FIG. 28.
Figure 50:
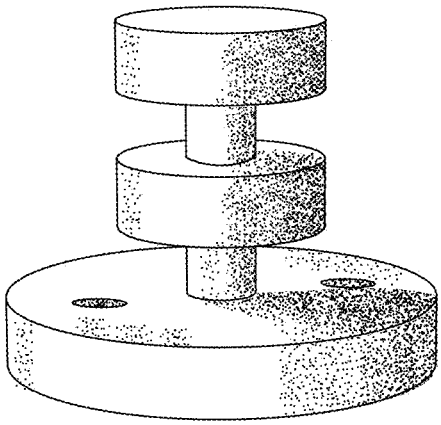
FIG. 50 illustrates an aesthetic view of the vortexer of FIG. 33.
Figure 51:
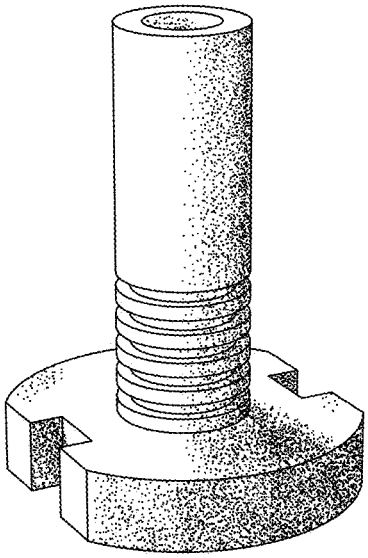
FIG. 51 illustrates an aesthetic view of the vortexer of FIG. 24.

FIG. 23 illustrates a flowchart 2300 of an airflow generation method for generating a vortex airflow for the personal vaporizer 102. The airflow-generation method may be configured to generate a vortex airflow within the personal vaporizer using a vortexer 202, which is explained via one or more steps hereinafter.

At step 2302, a cap 104 may be provided. The cap 104 may include a proximal cap end 302 and a distal cap end 304 oppositely formed to the proximal cap end 302. Further, the cap 104 may include an outer cap surface 306 formed between the proximal cap end 302 and the distal cap end 304, and an inner cap surface 308 defining a central cap axis. Further, the cap 104 may include one or more cap inlets 310 running from the outer cap surface 306 to the inner cap surface 308.

At step 2304, a vortexer 202 may be provided. The vortexer 202 may be accommodated within the cap 104. Further, the vortexer 202 may include a proximal end 402, vertically offset to the proximal cap end 302, and a distal end 404 emerging from the distal cap end 304 and configured to interface with a mouth of a user.

At step 2306, a tube 406 may be provided. The tube 406 may protrude between the proximal end 402 and the distal end 404. Further, the tube 406 may define a central axis $P_c$. Further, the tube 406 may include an inner wall 408 concentrically formed about the central axis $P_c$, and an outer wall 410 concentrically formed about the central axis $P_c$. Further, the outer wall 410 of the tube 406 may include an insulated coating 405 and a heat-convector 504 which may collectively regulate the temperature of the vortexer 202.

At step 2308, a shoulder 412 may be provided. The shoulder 412 may protrude from the proximal end 402 towards the distal end 404. The shoulder 412 may include a bottom face 414, coplanar to the proximal end 402 of the vortexer and perpendicular to the central axis. Further, the shoulder 412 may include a top face 416 parallel to and offset from the bottom face 414, wherein the top face 416 is perpendicular to the central axis $P_c$. Further, the shoulder 412 may include an outer perimeter concentrically formed about the central axis $P_c$ between the bottom face 414 and the top face 416. The shoulder 412 may include a first inlet 204 formed between the top face 416 and the bottom face 414. The first inlet defines a first inlet axis Fi. Further, the first inlet axis Fi is radially-offset from, nonparallel-to, and non-intersecting the central axis $P_c$. Further, the shoulder 412 may include a second inlet 206 formed between the top face 416 and the bottom face 414. The second inlet 206 defines a second inlet axis Si. Further, the second inlet axis Si is radially-offset from, nonparallel-to, non-intersecting the central axis $P_c$, and concentrically opposite from the first inlet 204. At step 2310, a vortex airflow may be generated from the proximal end 402 by the first inlet 204 and the second inlet 206 when subjected to an inhalation action by the user at the distal end 404.

With reference to FIGS. 24-28, an ornamental appearance of a vortexer 202 may include features as illustrated or may have various features not illustrated, modified, and/or removed. For example, the first inlet and the second inlet may be positioned at a predefined angle from the central axis.

With reference to FIGS. 29-33, an ornamental appearance of a vortexer 202 may include features as illustrated or may have various features not illustrated, modified, and/or removed. For example, the vortexer 202 herein may first inlet and the second inlet may be positioned at a predefined angle from the central axis, and the insulated coating 405 may be formed throughout the tube.

With reference to FIGS. 34-38, an ornamental appearance of a vortexer 202 may include features as illustrated or may have various features not illustrated, modified, and/or removed. For example, the vortexer 202 may include the distal end of the tube formed as a tapered structure.

With reference to FIGS. 39-43, an ornamental appearance of a vortexer 202 may include features as illustrated or may have various features not illustrated, modified, and/or removed. For example, the vortexer 202 may include the tube comprising at least one flange formed on an outer surface thereon.

With reference to FIGS. 44-48, an ornamental appearance of a vortexer 202 may include features as illustrated or may have various features not illustrated, modified, and/or removed. For example, the vortexer 202 may include the shoulder adjoined to an extended base, and the extended base may further include the first inlet and a second inlet.

With reference to FIGS. 49-52, an ornamental appearance of a vortexer 202 may include features as illustrated or may have various features not illustrated, modified, and/or removed as illustrated in FIGS. 18-42.

The methods, systems, devices, graphs, and/or tables discussed herein are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of +20% or +10%, +5%, or +0.1% from the specified value, as such variations are appropriate to in the context of the systems, devices, circuits, methods, and other implementations described herein. "Substantially" as used herein when referring to a measurable value such as an amount, a temporal duration, a physical characteristic vectors (such as frequency), and the like, also encompasses variations of +20% or +10%, +5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

While illustrative and presently preferred embodiments of the disclosed systems, methods, and/or machine-readable media have been described in detail herein, it is to be understood that the inventive concepts may be otherwise variously embodied and employed and that the appended claims are intended to be construed to include such variations, except as limited by the prior art. While the principles of the disclosure have been described above in connection with specific apparatuses and methods, it is to be clearly understood that this description is made only by way of example and not as a limitation on the scope of the disclosure.

What is claimed is:

1. A vortexer for a cap of a personal vaporizer, the vortexer comprising:
- a proximal end configured to adjoin to the personal vaporizer;
- a distal end configured to interface with a mouth of a user;
- a tube protruding between the proximal end and the distal end, wherein the tube defines a central axis, the tube comprising:
  - an inner wall concentrically formed about the central axis; and
  - an outer wall concentrically formed about the central axis; and
- a shoulder protruding from the proximal end towards the distal end, the shoulder comprising:
  - a bottom face, coplanar to the proximal end of the vortexer and perpendicular to the central axis;
  - a top face parallel to and offset-from the bottom face, wherein the top face is perpendicular to the central axis;
  - an outer perimeter concentrically formed about the central axis between the bottom face and the top face;
  - a first inlet formed in the shoulder between the top face and the bottom face, wherein the first inlet defines a first inlet axis, wherein the first inlet axis is:
    - radially-offset from,
    - nonparallel-to, and
    - non-intersecting the central axis; and
  - a second inlet formed in the shoulder between the top face and the bottom face, wherein the second inlet defines a second inlet axis, wherein the second inlet axis is:
    - radially-offset from,
    - nonparallel-to,
    - non-intersecting the central axis, and
    - concentrically opposite from the first inlet;
- wherein the first inlet and the second inlet are configured to generate a vortex airflow from the proximal end when subjected to an inhalation action of the user at the distal end.

2. The vortexer of claim 1, wherein the tube further comprises:
- a mouth portion at the distal end; and
- an insulated portion adjoining the mouth portion.

3. The vortexer of claim 2 and further comprising:
- a coating formed on the mouth portion, the coating comprising at least one of:
  - a metal coating dissimilar to a composition of the tube,
  - a polymer resin, and
  - texture.

4. The vortexer of claim 1, wherein the tube further comprises:
- a heat-convector formed between the proximal end of the tube and the top face of the shoulder, the heat-convector comprising:
  - at least a first circumferential fin formed on the outer wall,
- wherein the heat-convector is configured to transfer heat from the vortexer to the vortex airflow.

5. The vortexer of claim 1, wherein the shoulder further comprises:
- a first detent formed in the outer perimeter; and
- a second detent formed in the outer perimeter oppositely disposed from the first detent,
- wherein the first detent and the second detent are configured to axially align the vortexer relative to the cap.

6. The vortexer of claim 5, wherein the shoulder further comprises:
- a first slot formed in the first detent; and
- a second slot formed in the second detent.

7. A cap of a personal vaporizer, the cap comprising:
- a proximal cap end;
- a distal cap end oppositely formed to the proximal cap end;
- an outer cap surface formed between the proximal cap end and the distal cap end;
- an inner cap surface defining a central cap axis; and
- a vortexer accommodated within the cap, the vortexer comprising:
  - a proximal end, vertically offset to the proximal cap end;
  - a distal end emerging from the inner cap surface and configured to interface with a mouth of a user;

a tube protruding between the proximal end and the distal end, wherein the tube defines a central axis coinciding with the central cap axis, the tube comprising:

an inner wall concentrically formed about the central axis; and an outer wall concentrically formed about the central axis; and a shoulder protruding from the proximal end towards the distal end, the shoulder comprising:

a bottom face, coplanar to the proximal end of the vortexer and perpendicular to the central axis;

a top face parallel to and offset-from the bottom face, wherein the top face is perpendicular to the central axis;

an outer perimeter concentrically formed about the central axis between the bottom face and the top face;

a first inlet formed in the shoulder between the top face and the bottom face, wherein the first inlet defines a first inlet axis, wherein the first inlet axis is:

radially-offset from, nonparallel-to, and non-intersecting the central axis; and a second inlet formed in the shoulder between the top face and the bottom face, wherein the second inlet defines a second inlet axis, wherein the second inlet axis is:

radially-offset from, nonparallel-to, non-intersecting the central axis, and concentrically opposite from the first inlet;

wherein the first inlet and the second inlet are configured to generate a vortex airflow from the proximal end when subjected to an inhalation action of the user at the distal end.

8. The cap of claim 7, wherein the tube further comprises:

a mouth portion at the distal end.

9. The cap of claim 8 and further comprising:

an insulated coating formed on the mouth portion, the insulated coating comprising at least one of:

a metal coating dissimilar to a composition of the tube, a polymer resin, and texture.

10. The cap of claim 7, wherein the tube further comprises:

a heat-convector formed between the proximal end of the tube and the top face of the shoulder, the heat-convector comprising:

at least a first circumferential fin formed on the outer wall, wherein the heat-convector is configured to transfer heat from the vortexer to the vortex airflow.

11. The cap of claim 7, wherein the shoulder further comprises:

a first detent formed in the outer perimeter; and a second detent formed in the outer perimeter oppositely disposed from the first detent;

wherein the first detent and the second detent are configured to axially align the vortexer relative to the cap.

12. The cap of claim 11, wherein the shoulder further comprises:

a first slot formed in the first detent; and a second slot formed in the second detent.

13. The cap of claim 7, wherein the outer cap surface further comprises:

one or more cap inlets, wherein each cap inlet from the one or more cap inlets is:

radially-offset from, and nonparallel-to the central cap axis.

14. The cap of claim 7, wherein the inner cap surface further comprises:

a sealant configured to seal the shoulder with the proximal cap end.

15. A personal vaporizer comprising:

a cap, comprising:

a proximal cap end;

a distal cap end oppositely formed to the proximal cap end;

an outer cap surface formed between the proximal cap end and the distal cap end; and an inner cap surface defining a central cap axis; and a vortexer accommodated within the cap, the vortexer comprising:

a proximal end vertically offset to the proximal cap end;

a distal end emerging from the inner cap surface and configured to interface with a mouth of a user;

a tube protruding between the proximal end and the distal end, wherein the tube defines a central axis coinciding with the central cap axis, the tube comprising:

an inner wall concentrically formed about the central axis; and an outer wall concentrically formed about the central axis; and a shoulder protruding from the proximal end towards the distal end, the shoulder comprising:

a bottom face, coplanar to the proximal end of the vortexer and perpendicular to the central axis;

a top face parallel to and offset-from the bottom face, wherein the top face is perpendicular to the central axis;

an outer perimeter concentrically formed about the central axis between the bottom face and the top face;

a first inlet formed in the shoulder between the top face and the bottom face, wherein the first inlet defines a first inlet axis, wherein the first inlet axis is:

radially-offset from, nonparallel-to, and non-intersecting the central axis; and a second inlet formed in the shoulder between the top face and the bottom face, wherein the second inlet defines a second inlet axis, wherein the second inlet axis is:

radially-offset from, nonparallel-to, non-intersecting the central axis, and concentrically opposite from the first inlet;

wherein the first inlet and the second inlet are configured to generate a vortex airflow from the proximal end when subjected to an inhalation action of the user at the distal end.

16. The personal vaporizer of claim 15, wherein the tube further comprises:

a mouth portion at the distal end.

17. The personal vaporizer of claim 16 and further comprising:

an insulated coating formed on the mouth portion, the insulated coating comprising at least one of:

a metal coating dissimilar to a composition of the tube, a polymer resin, and texture.

18. The personal vaporizer of claim 15, wherein the tube further comprises:

a heat-convector formed between the proximal end of the tube and the top face of the shoulder, the heat-convector comprising:

at least a first circumferential fin formed on the outer wall, wherein the heat-convector is configured to transfer heat from the vortexer to the vortex airflow.

19. The personal vaporizer of claim 15, wherein the shoulder further comprises:

a first detent formed in the outer perimeter; and a second detent formed in the outer perimeter oppositely disposed from the first detent;

wherein the first detent and the second detent are configured to axially align the vortexer relative to the cap.

20. An airflow-generation method for generating a vortex airflow in a cap of a personal vaporizer, the airflow-generation method comprising:

providing a cap, comprising:

a proximal cap end;

a distal cap end oppositely formed to the proximal cap end;

an outer cap surface formed between the proximal cap end and the distal cap end; and an inner cap surface defining a central cap axis;

providing a vortexer, wherein the vortexer is accommodated within the cap, the vortexer comprising:

a proximal end, vertically offset to the proximal cap end; and a distal end emerging from the inner cap surface and configured to interface with a mouth of a user;

providing a tube protruding between the proximal end and the distal end, wherein the tube defines a central axis, the tube comprising:

an inner wall concentrically formed about the central axis; and an outer wall concentrically formed about the central axis; and providing a shoulder protruding from the proximal end towards the distal end, the shoulder comprising:

a bottom face, coplanar to the proximal end of the vortexer and perpendicular to the central axis;

a top face parallel to and offset-from the bottom face, wherein the top face is perpendicular to the central axis;

an outer perimeter concentrically formed about the central axis between the bottom face and the top face;

a first inlet formed in the shoulder between the top face and the bottom face, wherein the first inlet defines a first inlet axis, wherein the first inlet axis is:

radially-offset from, nonparallel-to, and non-intersecting the central axis; and a second inlet formed in the shoulder between the top face and the bottom face, wherein the second inlet defines a second inlet axis, wherein the second inlet axis is:

radially-offset from, nonparallel-to, non-intersecting the central axis, and concentrically opposite from the first inlet;

wherein the first inlet and the second inlet are configured to generating a vortex airflow from the proximal end when subjected to an inhalation action of the user at the distal end.

21. The airflow-generation method of claim 20, wherein providing the tube further comprises:

providing a mouth portion at the distal end.

22. The airflow-generation method of claim 21, wherein providing the mouth portion further comprises:

providing an insulated coating, wherein the insulated coating is formed on the mouth portion, the insulated coating comprising at least one of:

a metal coating dissimilar to a composition of the tube, a polymer resin, and texture.

23. The airflow-generation method of claim 20, wherein providing the tube further comprises:

providing a heat-convector formed between the proximal end of the tube and the top face of the shoulder, the heat-convector comprising:

at least a first circumferential fin formed on the outer wall, wherein the heat-convector is configured to transfer heat from the vortexer to the vortex airflow.

24. The airflow-generation method of claim 20, wherein providing the shoulder further comprises:

providing a first detent formed in the outer perimeter; and providing a second detent formed in the outer perimeter oppositely disposed from the first detent, wherein the first detent and the second detent are configured to axially align the vortexer relative to the cap.

* * * * *